US007351081B1

(12) United States Patent
Lai

(10) Patent No.: US 7,351,081 B1
(45) Date of Patent: Apr. 1, 2008

(54) MEMORY CARD CONNECTOR FOR AUTOMOBILE

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/798,664

(22) Filed: May 16, 2007

(30) Foreign Application Priority Data

Jan. 31, 2007 (TW) ..... 96103595 A

(51) Int. Cl.
*H01R 13/62* (2006.01)

(52) U.S. Cl. ..... 439/159

(58) Field of Classification Search ..... 439/159, 439/160, 152, 153, 154, 155
See application file for complete search history.

(56) References Cited

U.S. PATENT DOCUMENTS

| | | | | |
|---|---|---|---|---|
| 6,942,507 | B1 * | 9/2005 | Wu et al. | 439/159 |
| 6,951,471 | B1 * | 10/2005 | Chen | 439/159 |
| 7,004,770 | B2 * | 2/2006 | Wu | 439/159 |
| 7,198,497 | B1 * | 4/2007 | Lai et al. | 439/159 |
| 7,229,300 | B2 * | 6/2007 | Lai et al. | 439/159 |
| 7,303,413 | B1 * | 12/2007 | Lai et al. | 439/152 |
| 2005/0186817 | A1 * | 8/2005 | Yang et al. | 439/159 |
| 2005/0221649 | A1 * | 10/2005 | Tanaka et al. | 439/159 |
| 2007/0149017 | A1 * | 6/2007 | Hsu et al. | 439/159 |
| 2007/0218727 | A1 * | 9/2007 | Ting et al. | 439/159 |
| 2007/0270005 | A1 * | 11/2007 | Cheng | 439/159 |

FOREIGN PATENT DOCUMENTS

| | | |
|---|---|---|
| CN | 200420047939.5 | 3/2005 |
| CN | 200520105617.6 | 10/2006 |

* cited by examiner

*Primary Examiner*—Michael C. Zarroli
*Assistant Examiner*—Phuongchi Nguyen
(74) *Attorney, Agent, or Firm*—Bacon & Thomas, PLLC

(57) ABSTRACT

A memory card connector for automobile includes a main member including an upper lid, a lower lid, a base, a sliding block and an eject mechanism. The upper lid includes a spring piece to press the sliding block. The sliding block has a pin at opposite sides respectively. The lower lid has a first rail and the upper lid has a second rail to guide the pin. When the card is inserted, the card pushes the sliding slot backwards and to move the pin along the first rail until it is secured. When an eject key is pressed, the upper lid moves backwards to compress the first spring and to force the pin leaving the first rail and entering the second rail to return the pin along the second rail to an initial position thereof. The present invention fits the vibrating and dusty environment of the automobile.

10 Claims, 8 Drawing Sheets

MEMORY CARD CONNECTOR FOR AUTOMOBILE

BACKGROUND OF THE INVENTION

1. Field of the Invention

The present invention relates generally to an electronic card connector, and more particularly to a memory card connector for automobile.

2. Description of the Related Art

To achieve the application of the memory card on automobile, the multimedia player for automobile is equipped with a common memory card connector. There are many different structures of the memory card connectors, such as China patent Publication no. CN200420047939.5, which has a cassette slot with card positioning structure. Such memory card connector has the slot with a top side gradually higher from an inner end to an outer end and a stop piece on a bottom side of the outer end of the slot that a card may be inserted into the slot from an opening above the stop piece, and turns to horizontal when cross the stop piece. The card is stopped by the stop piece for restriction in the slot. This kind of memory card connector is shockproof. Another China patent, Publication no. CN200520105617.6, disclosed an electronic card connector, which includes an insulating base, a plurality of terminals fixed on the insulating base, a dustproof device, an elastic member and a mask device covering the insulating base. The insulating base includes a main member at a rear thereof and two arms projected from the left and right sides of the main member to form a slot therebetween. Each of the arms has an inner side facing the slot and a stop block projected from the inner side adjacent to a free end thereof to the other arm. The stop blocks are coplanarity to define an opening to be an entrance of the slot. The dustproof device is pivotally provided on the arms and behind the stop blocks to be moved between a close position, in which the dustproof device leans on the stop block to close the opening, and an open position, in which the dustproof device is away from the opening. The elastic member is provided on the arm to urge the dustproof device toward the stop blocks. In other words, the elastic member is capable of returning the dustproof device from the open position to the close position that provides a dustproof function.

In conclusion, the prior arts provide shockproof and dustproof functions in a common point of view to increase the electrical connection. However, these conventional connectors are not specially designed for automobile that could not fit the vibrating and dusty environment in the automobile.

SUMMARY OF THE INVENTION

The primary objective of the present invention is to provide a memory card connector for automobile, which design to overcome the above drawbacks and for the vibrating, dusty and high temperature environment in the automobile specially.

According to the objective of the present invention, a memory card connector for automobile includes a main member, which has an opening at a front thereof to be an entrance of a memory card, including an upper lid, a lower lid, a base, a sliding block and an eject mechanism. Said upper lid includes two side walls and a top side, wherein at least one spring piece, which is curved downwards to press said sliding block, is provided on the top side of said upper lid. Said lower lid includes two side walls, a bottom side and a front stop device vertically connected to a front end of the bottom side. Said upper lid fits said lower lid. Said eject mechanism includes a first spring between said upper lid and said lower lid and an eject key on said upper lid. Said sliding block, which is between said upper lid and said lower lid, is provided with a space to receive the memory card, wherein a front end of said sliding block corresponds to said opening and a rear end thereof corresponds to said base. Said base is provided with at least a terminal set, which fits conducting plates on the card, wherein the terminal set has an end extending to said space of said sliding block and the other end extending out of a rear of the base. Said sliding block has a pin at opposite sides respectively. Said lower lid has a first rail on the side wall to guide said pin, and said upper lid has a second rail on the side wall to guide said pin. When the card is inserted, the card will push said sliding slot backwards and to make said pin on said sliding block moving along said first rail until the pin is secured. When said eject key is pressed, said upper lid moves backwards relative to said lower lid to compress said first spring and to force said pin leaving said first rail and entering said second rail that said first spring will moves said upper lid to return said pin along said second rail to an initial position thereof.

The memory card connector of the present invention further includes an elastic frame including a leg portion, a head portion and an arm portion, wherein said sliding block has a slot to receive said leg portion of said elastic frame therein, and said arm portion of said elastic frame extends forwards and said heat portion thereof presses said front stop device of said lower lid when the card is not inserted yet.

The memory card connector of the present invention further includes a second spring between said sliding block and said base.

Said first rail has a knife shape with a knife handle portion at said lower lid adjacent to a front end thereof, a knife body portion at said lower lid adjacent to a rear end thereof, and a flat back of blade portion at said lower lid adjacent to a top end, and an included angle between a knife edge portion at said lower lid adjacent to the front end and a blade portion at said lower lid adjacent to a bottom end is an acute angle.

Said second rail has a knife shape with a knife handle portion at said upper lid adjacent to a front end thereof, a knife body portion at said upper lid adjacent to a rear end thereof, and a flat back of blade portion at said upper lid adjacent to a top end, and an included angle between a knife edge portion at said upper lid adjacent to the front end and a blade portion at said lower lid adjacent to a bottom end is an obtuse angle.

A fitness of said upper lid and said lower lid includes a protrusion on said lower lid and slot on said upper lid to receive said protrusion therein, and said protrusion has a length less than that of said slot.

There are two of said terminal sets on said base, one of which is designated for MS card, and the other of which is designated for SD card.

The memory card connector of the present invention further includes a panel, which is fixed to said front of said main member, having an opening corresponding to said opening of said main member, wherein said eject key of said upper lid extends out of said panel. And a gate, a shaft and a torsional spring are provided also, wherein said gate is provided on said panel through said shaft and said torsional spring between said opening of said panel and said main member.

The memory card connector of the present invention further includes a bottom plate vertically connected to said panel, and a substrate on said bottom plate, wherein said main member is on said substrate, and said terminal set of said base has an end extending out of a rear end of said base to connect said substrate.

When the memory card is inserted to the secure position, the connector may press six sides of the card that provides a well function of shockproof. Together with the gate, it provides a secondary function of dustproof.

To compare to the prior arts, the memory card connector of the present invention fit the vibrating and dusty environment of the automobile.

DETAILED DESCRIPTION OF THE INVENTION

Figure 1:
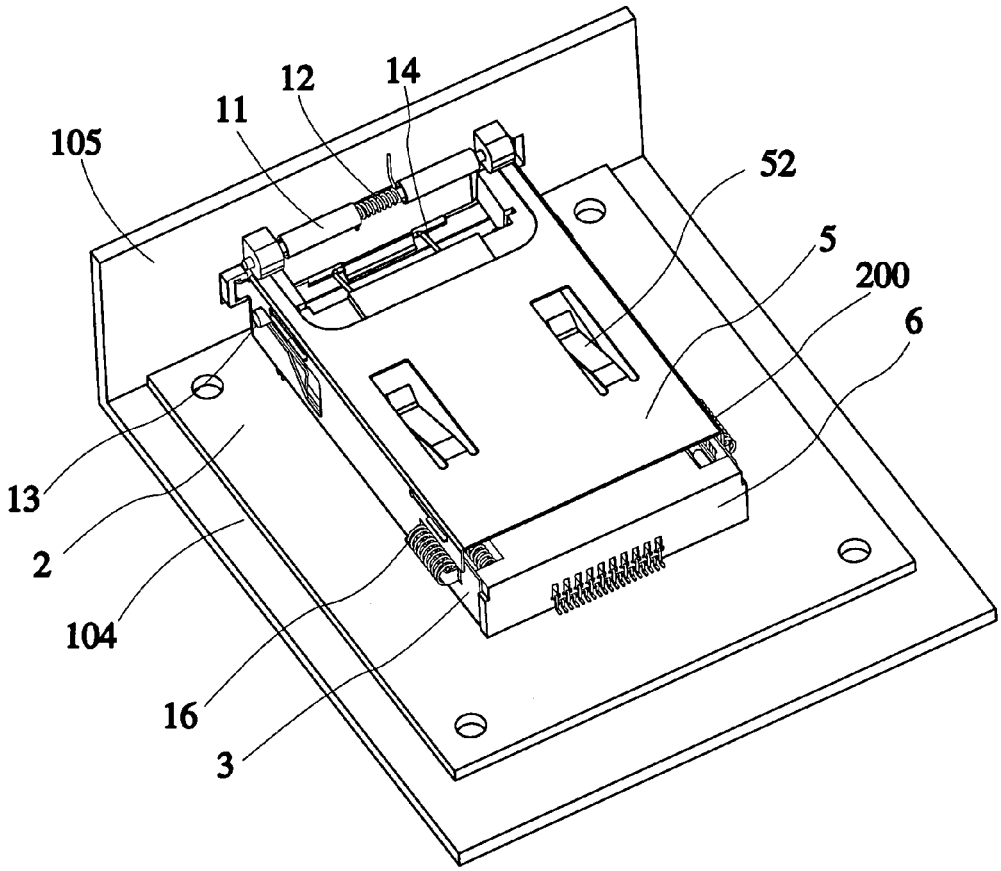
FIG. 1 is a perspective view of a preferred embodiment of the present invention.
Figure 2:
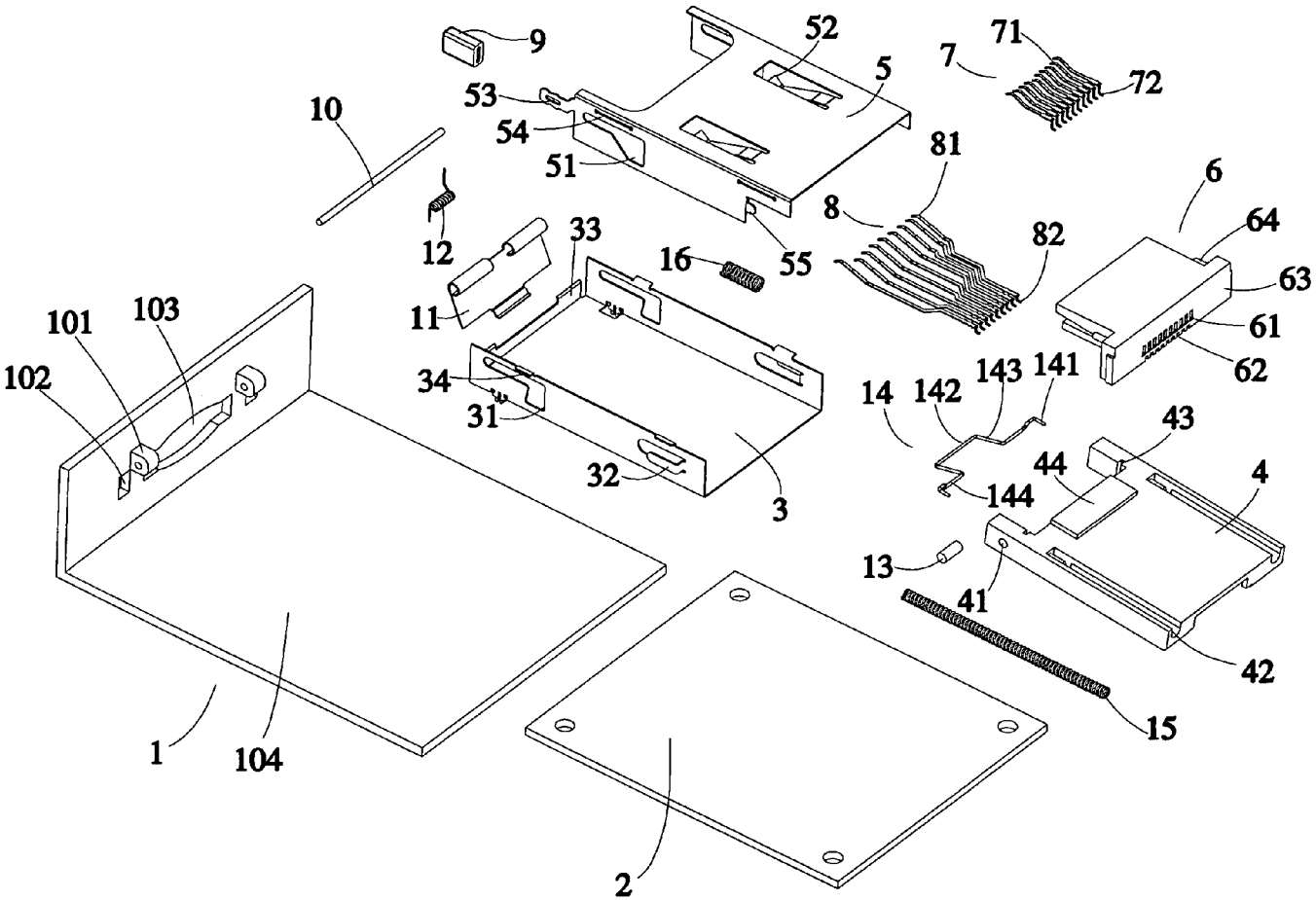
FIG. 2 is an exploded view of the preferred embodiment of the present invention.

As shown in FIG. 1 to FIG. 12, a memory card connector for automobile of the preferred embodiment of the present invention includes a housing 1, a substrate 2, which is a printed circuit board, on a bottom plate 104 of the housing 1, and a main member 200 of the memory card connector rested on the substrate 2. The main member 200 has a front end fixed to a panel 105 of the housing 11 and a rear end welded to substrate through guiding legs. The main member 200 of the memory card connector includes a lower lid 3, a sliding block 4, an upper lid 5, a base 6, a dustproof gate 11, a torsional spring 12, a pin 13, an elastic frame 14, a second spring 15, a first spring 16, a first connecting terminal set 7 and a second connecting terminal set 8. The first connecting terminal set 7 includes a contacting portion 71 in the connector and guiding legs 82 extended through a first opening set 63 on a rear wall 63 of the base 6. The first connecting terminal set 7 is designated to connect a MS card, and the second connecting terminal set 8 is designated to connect a SD card.

The connection of the lower lid 3 and the upper lid 5 mainly depend on the engagement of a protrusion 34 on the lower lid 3 and a slot 54 on the upper lid 5. A length of the slot 54 is greater than that of the protrusion 34 that the protrusion 34 may move along the slot 54. The connection of the lower lid 3 and the upper lid 5 also depend on the first spring 16, which has opposite end urging a spring fixing portion 32 on the lower lid 3 and a spring fixing portion 55 on the upper lid 5. The upper lid 5 is provided with an eject key seat 53 at a front thereof to fit an eject key hat 9 thereto and go through a key hole 102 the panel 105 that user may press the eject key hat 9 to move the upper lid 5 toward a rear of the lower lid 3 and return by the first spring 16 in an eject card process.

The sliding block 4, which is between the lower lid 3 and the upper lid 5, has the elastic frame 14 at a front thereof to be fitted to a front stop device 33 on the lower lid 3. The elastic frame 14 includes two leg portions 141, a head portion 142, two upper arms 143 and two lower arms 144. The leg portions 141 are inserted into slots 43 on the sliding block 4. The sliding block 4 has a block 44 with a rear end fitting to the base 6 at a top thereof to prevent the card from error insertion. When a card 100 is inserted into an opening 103 of the panel 105, a bottom position is limited by the elastic frame 14 to be guided to a card space between the sliding block 4 and the lower lid 3. The movement of the card 100 may push the sliding block 4 to a rear end and compress the second spring 15. The second spring 15, which is received a spring slot on the sliding block 4, has opposite ends urging spring fixing portion 64 on the base 6 and the sliding block 4 respectively to buffer the sliding block 4.

The sliding block 4 has two bores 4 at opposite sides of a front thereof and the pin 13 between the bores 41. The lower lid 3 and the upper lid 5 are provided with a rail 31, 51 respectively for the pin 13. The pin 13 is extended out of the lower lid 3 and the upper lid 5 through an overlapped portion thereof. The rails 31 and 51 have a knife shape, in which a knife handle is the front end thereof, a knife body the rear end, a back of the blade on the upper end is flat and the a blade on the bottom end has different shapes. The knife body of the rail 31 is a trapezoid structure, and the front knife edge is substantially vertical. An included angle between the knife edge and the bottom blade is an acute angle and close to a right angle. The knife body of the rail 51 is a trapezoid structure, and the front knife edge is an inclined side. The blade and the back of the blade form the top side and the bottom side of the trapezoid. An included angle between the knife edge adjacent to the front end and the blade adjacent to the bottom end is an obtuse angle. The difference and purpose of theses structures are that the rail 31 may secure the pin 13 at the included angle between the front knife edge and the bottom blade when the card is inserted, and the rail 51 returns the pin 13 along the slope of the front knife edge.

Figure 3:
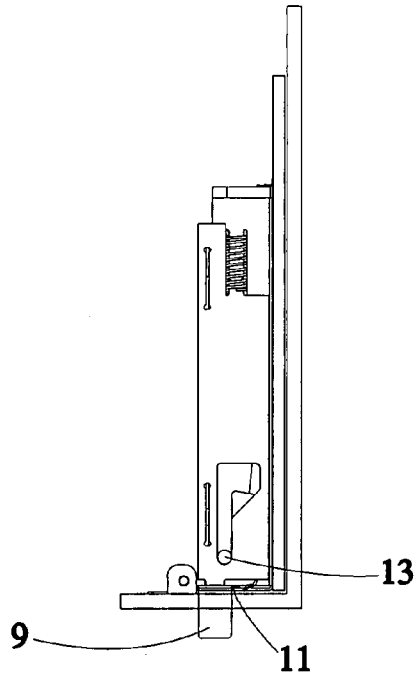
FIG. 3 is a sketch diagram of the preferred embodiment of the present invention before the card had been inserted.

Before the card 100 has been inserted, as shown in FIG. 3, the eject key hat 9 is totally extended out of the panel 105, and the dustproof gate 11 is at the close position, against the panel 105, and the pin 13 is at the initial position, between the rear ends of the knife handles of the knife shape of the rails 31 and 51.

Figure 4:
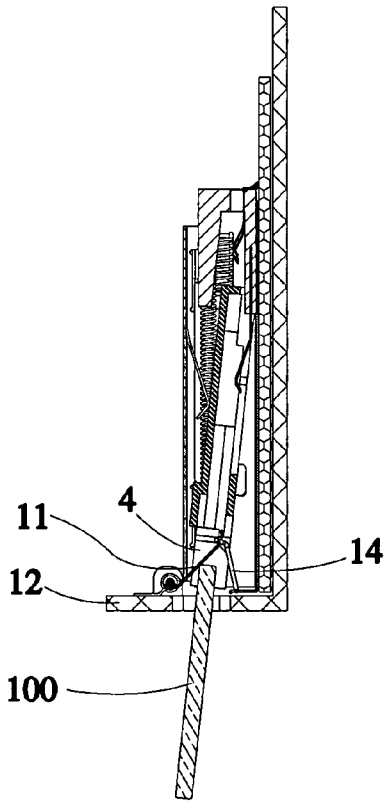
FIG. 4 is a sketch diagram of the preferred embodiment of the present invention, showing the first initial condition of the card being inserted.
Figure 5:
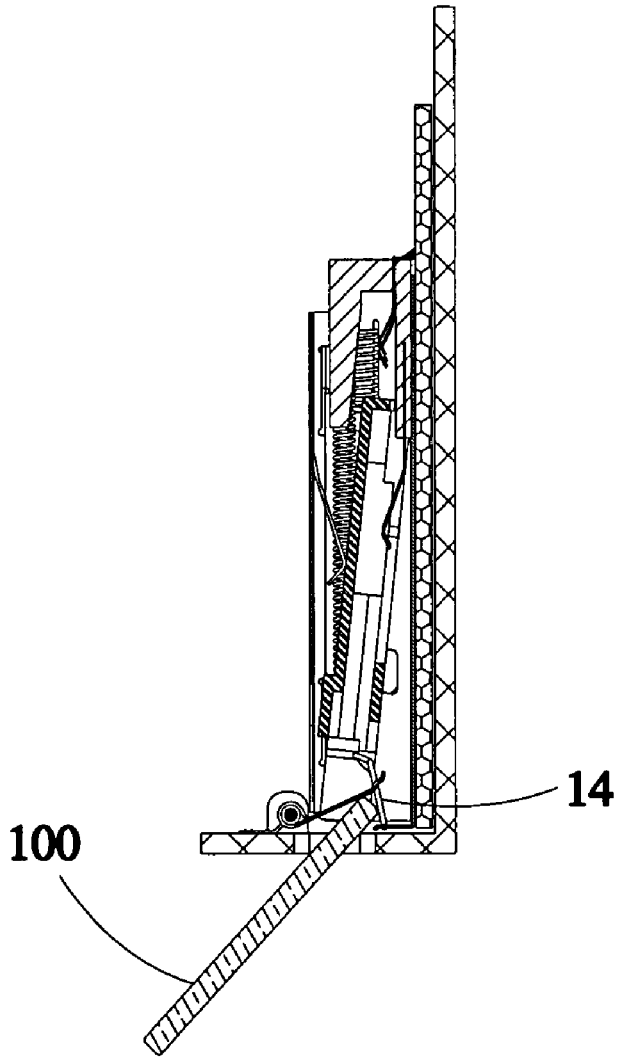
FIG. 5 is a sketch diagram of the preferred embodiment of the present invention, showing the second initial condition of the card being inserted.

When the card 100 had just been inserted, as shown in FIG. 4, the dustproof gate 11 is opened, and the head portion 142 of the elastic frame 14 and the front stop device 33 of the lower lid 3 are separated. The space of the slide block 4 between the upper lid 3 and the lower lid 5 arises, and the torsional spring 12 provides a spring force to close the gate, the spring piece 52 provides a spring force to press the sliding block 4 downwards. As shown in FIG. 5, if the card 100 is inserted along a wrong angle, the bottom of the card 100 will be restricted by the elastic frame 14.

Figure 6:
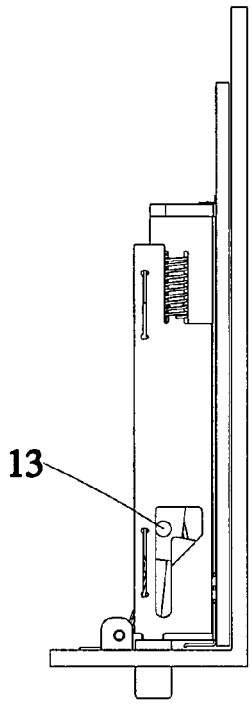
FIG. 6 is a sketch diagram of the preferred embodiment of the present invention, showing the card to the deepest position.
Figure 7:
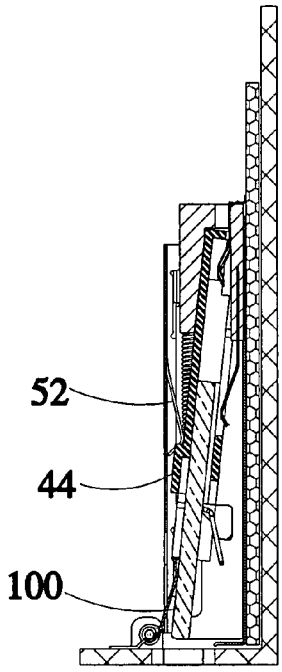
FIG. 7 is a sectional view of FIG. 6.

When the card 100 is inserted to the deepest position, as shown in FIG. 6, the pin 13 moves to the knife body of the knife structure adjacent to the back of the blade of the rails 31 and 51 that will be expected to fall down, i.e. along the blade direction, at this time, FIG. 7 shows the card 100 in the connector.

Figure 8:
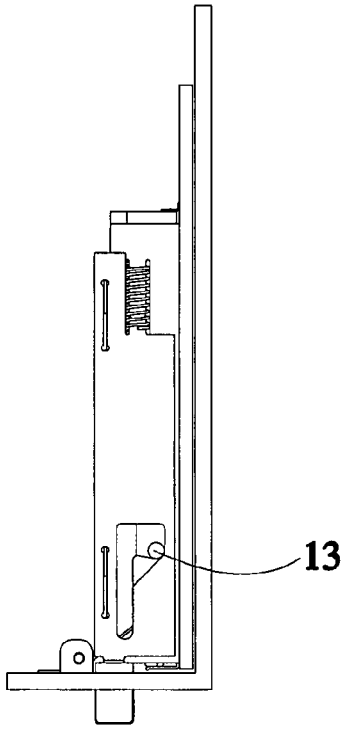
FIG. 8 is a sketch diagram of the preferred embodiment of the present invention, showing the card being secured.
Figure 9:
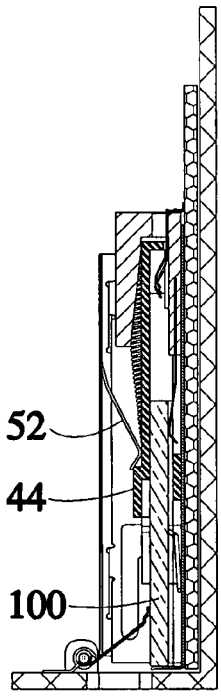
FIG. 9 is a sectional view of FIG. 8.

When keep pushing the card 100 to a secure position, as shown in FIG. 8, the pin 13 arrives the blade of the knife body of the knife structure of the rails 31 and 51 that the card 100, together with the sliding block 4, is at the same level with the lower lid 3. as shown in FIG. 9, all sides of the card 100 are pressed, in which the front end thereof is pressed by the front stop device 33 of the lower lid 3, the rear end, the top end and left and right sides thereof are pressed by an inner structure of the sliding block 4, and the bottom end thereof is pressed by the lower lid 3. The top of the sliding block 4 is pressed by the spring piece 52 of the upper lid 5, and the dustproof gate 11 is urged by the torsional spring 12 to have the bottom pressing the top of the card 100. Conducting plates on the bottom of the card 100 contact the contacting portions 71 of the first connecting terminal set 7 or the contacting portions 81 of the second connecting terminal set 8 to electrically connect the card 100 and the substrate 2 through the guiding legs 72 or 82. Because the card is pressed at all sides, it will provides a stable electrical connection when the automobile running and causes vibration. Furthermore, the dustproof gate 11 presses the top of the card 100 that may isolate dust from entering the connector.

Figure 10:
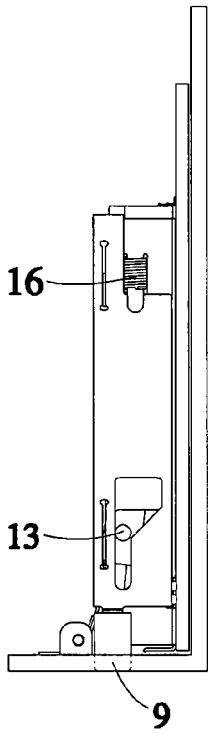
FIG. 10 is a sketch diagram of the preferred embodiment of the present invention, showing the initial condition of ejecting the card.
Figure 11:
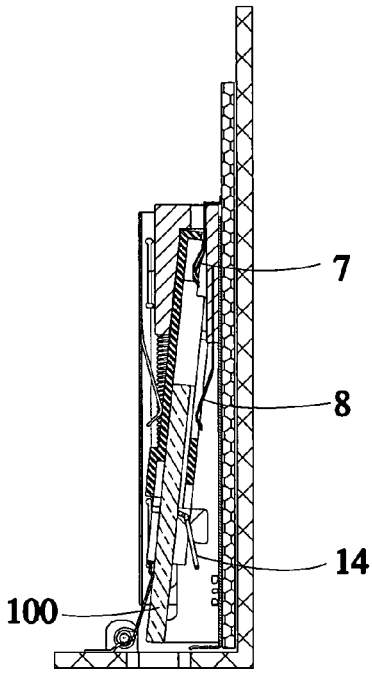
FIG. 11 is a sectional view of FIG. 10.
Figure 12:
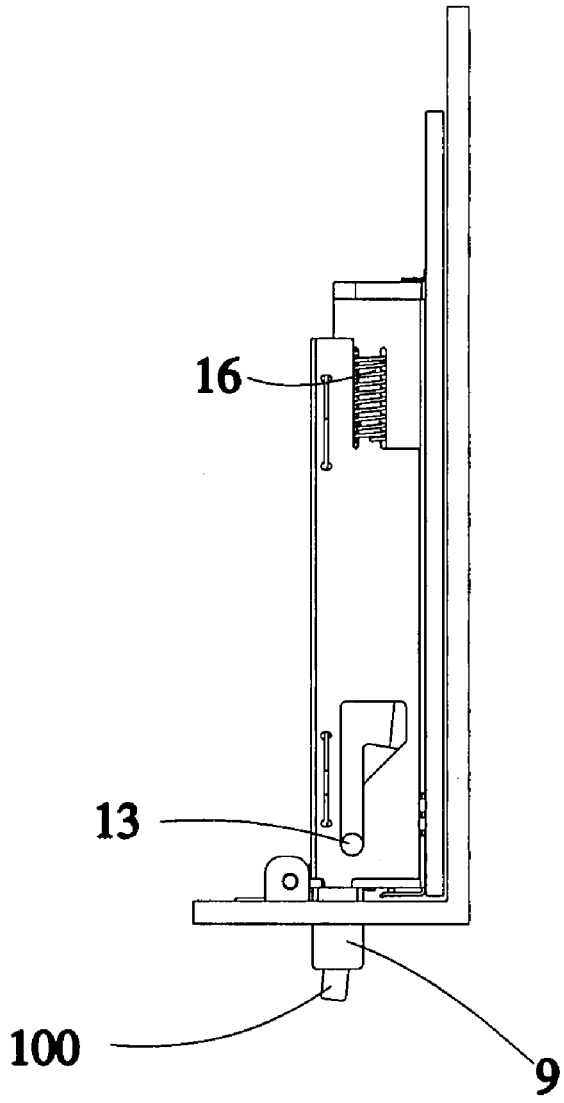
FIG. 12 is a sketch diagram of the preferred embodiment of the present invention, showing the middle condition of ejecting the card.

To eject the card 100 from the connector, as shown in FIG. 10, user only has to press the eject key hat 9. In this time, the first spring 16 is compressed, and the pin 13 returns along the front knife edge of the knife body of the rail 51 to the knife handle without the block of the front knife edge in the knife body of the rail 31. In the meantime, FIG. 11 shows the position of the card 100 in the connector that is basically as same as the structure shown in FIG. 7, in which the card 100 is inserted into the deepest position. And then, with the recovery force of the first spring 16, the pin 13 moves along the knife handle of the rail to the initial position, and the card 100 is ejected from the opening.

The characters of the present invention are the pin on the sliding block between the upper lid and the lower lid, the opening at the overlapped and part separating portions between the upper lid and the lower lid to form the rail for the pin, and the spring piece on the upper lid to press the sliding block to provides the card being pressed at six sides thereof. The description above is a few preferred embodiments of the present invention and the equivalence of the present invention is still in the scope of the claim of the present invention.

What is claimed is:

1. A memory card connector for automobile, comprising:

a main member, which has an opening at a front thereof to be an entrance of a memory card, including an upper lid, a lower lid, a base, a sliding block and an eject mechanism;

said upper lid including two side walls and a top side, wherein at least one spring piece, which is curved downwards to press said sliding block, is provided on the top side of said upper lid;

said lower lid including two side walls, a bottom side and a front stop device vertically connected to a front end of the bottom side;

said upper lid fitting said lower lid;

said eject mechanism including a first spring between said upper lid and said lower lid and an eject key on said upper lid;

said sliding block, which is between said upper lid and said lower lid, provided with a space to receive the memory card, wherein a front end of said sliding block corresponds to said opening and a rear end thereof corresponds to said base;

said base provided with at least a terminal set, which fits conducting plates on the card, wherein the terminal set has an end extending to said space of said sliding block and the other end extending out of a rear of the base;

said sliding block having a pin at opposite sides respectively; said lower lid having a first rail on the side wall to guide said pin; and said upper lid having a second rail on the side wall to guide said pin;

wherein when the card is inserted, the card will push said sliding slot backwards and to make said pin on said sliding block moving along said first rail until the pin is secured;

wherein when said eject key is pressed, said upper lid moves backwards relative to said lower lid to compress said first spring and to force said pin leaving said first rail and entering said second rail that said first spring will moves said upper lid to return said pin along said second rail to an initial position thereof.

2. The memory card connector for automobile as defined in claim 1, further comprising an elastic frame including a leg portion, a head portion and an arm portion, wherein said sliding block has a slot to receive said leg portion of said elastic frame therein, and said arm portion of said elastic frame extends forwards and said heat portion thereof presses said front stop device of said lower lid when the card is not inserted yet.

3. The memory card connector for automobile as defined in claim 1, further comprising a second spring between said sliding block and said base.

4. The memory card connector for automobile as defined in claim 1, wherein said first rail has a knife shape with a knife handle portion at said lower lid adjacent to a front end thereof, a knife body portion at said lower lid adjacent to a rear end thereof, and a flat back of blade portion at said lower lid adjacent to a top end, and an included angle between a knife edge portion at said lower lid adjacent to the front end and a blade portion at said lower lid adjacent to a bottom end is an acute angle.

5. The memory card connector for automobile as defined in claim 1, wherein said second rail has a knife shape with a knife handle portion at said upper lid adjacent to a front end thereof, a knife body portion at said upper lid adjacent to a rear end thereof, and a flat back of blade portion at said upper lid adjacent to a top end, and an included angle between a knife edge portion at said upper lid adjacent to the front end and a blade portion at said lower lid adjacent to a bottom end is an obtuse angle.

6. The memory card connector for automobile as defined in claim 1, wherein a fitness of said upper lid and said lower lid includes a protrusion on said lower lid and slot on said upper lid to receive said protrusion therein, and said protrusion has a length less than that of said slot.

7. The memory card connector for automobile as defined in claim 1, wherein there are two of said terminal sets on said base.

8. The memory card connector for automobile as defined in claim 1, further comprising a panel, which is fixed to said front of said main member, having an opening corresponding to said opening of said main member, wherein said eject key of said upper lid extends out of said panel.

9. The memory card connector for automobile as defined in claim 8, further comprising a gate, a shaft and a torsional spring, wherein said gate is provided on said panel through said shaft and said torsional spring between said opening of said panel and said main member.

10. The memory card connector for automobile as defined in claim 8, further comprising a bottom plate vertically connected to said panel, and a substrate on said bottom plate, wherein said main member is on said substrate, and said terminal set of said base has an end extending out of a rear end of said base to connect said substrate.

* * * * *